US010247154B2

(12) United States Patent
Lege

(10) Patent No.: US 10,247,154 B2
(45) Date of Patent: Apr. 2, 2019

(54) FUEL PUMP

(71) Applicant: AUDI AG, Ingolstadt (DE)

(72) Inventor: Peer Christopher Lege, Bad Friedrichshall (DE)

(73) Assignee: AUDI AG, Ingolstadt (DE)

( * ) Notice: Subject to any disclaimer, the term of this patent is extended or adjusted under 35 U.S.C. 154(b) by 13 days.

(21) Appl. No.: 15/371,990

(22) Filed: Dec. 7, 2016

(65) Prior Publication Data

US 2017/0184064 A1 Jun. 29, 2017

(30) Foreign Application Priority Data

Dec. 24, 2015 (DE) ..... 10 2015 016 925

(51) Int. Cl.
*F04B 1/04* (2006.01)
*F02M 59/44* (2006.01)
(Continued)

(52) U.S. Cl.
CPC ..... *F02M 59/447* (2013.01); *F02D 41/3845* (2013.01); *F02M 39/02* (2013.01); *F02M 59/022* (2013.01); *F02M 59/027* (2013.01); *F02M 59/102* (2013.01); *F02M 59/20* (2013.01); *F02M 59/30* (2013.01); *F02M 63/02* (2013.01); *F02M 63/027* (2013.01); *F02M 63/0265* (2013.01); *F04B 1/0408* (2013.01); *F04B 1/0413* (2013.01); *F04B 1/0421* (2013.01); *F04B 9/042* (2013.01); *F04B 19/22* (2013.01); *F02D 41/0087* (2013.01)

(58) Field of Classification Search
CPC .... F02M 59/447; F02M 39/02; F02M 59/022; F02M 59/027; F02M 59/102; F02M 59/20; F02M 59/30; F02M 63/02; F02M 63/0265; F02M 63/027; F02D 41/3845; F02D 41/0087; F04B 1/0408; F04B 1/0413; F04B 1/0421; F04B 1/0435; F04B 9/042; F04B 19/22
USPC ..... 123/445
See application file for complete search history.

(56) References Cited

U.S. PATENT DOCUMENTS 5,161,509 A 11/1992 Krieger et al.
5,243,943 A 9/1993 Bofinger et al.
(Continued)

FOREIGN PATENT DOCUMENTS

CN 1089401 C 8/2002
CN 101498266 A 8/2009
(Continued)

OTHER PUBLICATIONS

European Search Report issued by the European Patent Office in European Application No. EP 16 19 8196 dated May 31, 2017.
(Continued)

*Primary Examiner* — Joseph J Dallo
*Assistant Examiner* — Yi-Kai Wang
(74) *Attorney, Agent, or Firm* — Henry M. Feiereisen LLC

(57) ABSTRACT

A fuel pump for conveying fuel includes a conveying unit having a cylinder, a plunger received in the cylinder, a pump spring received in the cylinder, an inner sleeve connected to the plunger, an outer sleeve in contact with the pump spring and in contact with a roller of a cam mechanism, and a locking bolt configured to detachably connect the inner and outer sleeves.

9 Claims, 2 Drawing Sheets

(51) Int. Cl.

| | |
|---|---|
| ***F02M 59/02*** | (2006.01) |
| ***F02M 59/10*** | (2006.01) |
| ***F02M 59/20*** | (2006.01) |
| ***F04B 9/04*** | (2006.01) |
| ***F04B 19/22*** | (2006.01) |
| ***F02M 63/02*** | (2006.01) |
| ***F02M 39/02*** | (2006.01) |
| ***F02D 41/38*** | (2006.01) |
| ***F02M 59/30*** | (2006.01) |
| *F02D 41/00* | (2006.01) |

(56) References Cited

U.S. PATENT DOCUMENTS

| | | | | |
|---|---|---|---|---|
| 6,497,207 | B2 | 12/2002 | Spath et al. | |
| 7,055,479 | B2 * | 6/2006 | Sailer | F01L 1/146 123/90.52 |
| 2002/0046718 | A1 * | 4/2002 | Spath | F01L 1/146 123/90.15 |
| 2004/0211375 | A1 * | 10/2004 | Spath | F01L 1/146 123/90.5 |
| 2006/0102149 | A1 * | 5/2006 | Furusawa | F02D 33/003 123/446 |
| 2007/0116583 | A1 * | 5/2007 | Aoki | F02M 47/027 417/437 |
| 2009/0138179 | A1 * | 5/2009 | Felton | F02D 41/3845 701/103 |
| 2009/0164093 | A1 | 6/2009 | Sczomak et al. | |

FOREIGN PATENT DOCUMENTS

| | | |
|---|---|---|
| DE | 3 642 883 A1 | 6/1988 |
| DE | 102 33 825 A1 | 2/2004 |
| EP | 0 857 860 | 8/1998 |
| FR | 2 998 929 | 6/2014 |

OTHER PUBLICATIONS

English translation of European Search Report issued by the European Patent Office in European Application No. EP 16 19 8196 dated May 31, 2017.

Chinese Search Report issued by the Chinese Patent Office in Chinese Application No. 201611207426X dated Sep. 5, 2018.

English translation of Chinese Search Report issued by the Chinese Patent Office in Chinese Application No. 201611207426X dated Sep. 5, 2018.

* cited by examiner

FUEL PUMP

CROSS-REFERENCES TO RELATED APPLICATIONS

This application claims the priority of German Patent Application, Serial No. 10 2015 016 925.4, filed Dec. 24, 2015, pursuant to 35 U.S.C. 119(a)-(d), the disclosure of which is incorporated herein by reference in its entirety as if fully set forth herein.

BACKGROUND OF THE INVENTION

The present invention relates to a fuel pump and to an injection system for a combustion engine.

The following discussion of related art is provided to assist the reader in understanding the advantages of the invention, and is not to be construed as an admission that this related art is prior art to this invention.

A plunger or tappet in a fuel pump is normally operated via a cam in a mechanically rigid manner. The plunger and the cam are hereby connected via a so-called roller cup, with a contact between the cam and the roller of the roller cup being ensured at any time by a spring which is located between the roller cup and a housing of the fuel pump.

It would be desirable and advantageous to provide an improved fuel pump to obviate prior art shortcomings.

SUMMARY OF THE INVENTION

According to one aspect of the present invention, a fuel pump for conveying fuel includes a conveying unit including a cylinder, a plunger received in the cylinder, a pump spring received in the cylinder, an inner sleeve connected to the plunger, an outer sleeve in contact with the pump spring and in contact with a roller of a cam mechanism, and a locking bolt configured to detachably connect the inner and outer sleeves.

A fuel pump according to the present invention involves a high pressure pump for delivery of fuel to a fuel accumulator of an injection system for a combustion engine of a motor vehicle for example. Fuel is hereby pressurized by the fuel pump and is stored under pressure in the fuel accumulator. Fuel under pressure can then be injected from the fuel accumulator into at least one combustion chamber of the combustion engine.

According to another advantageous feature of the present invention, the inner and outer sleeves can be connected to one another in a base position of the locking bolt, and the inner and outer sleeve can be detached from one another in a rest position of the locking bolt. When the locking bolt assumes the base position, the plunger and the roller are mechanically connected to one another via the inner and outer sleeves. A force is hereby transmitted between the plunger and the roller via the inner and outer sleeves. When the locking bolt assumes the rest position and the inner and outer sleeves are disconnected, the mechanical linkage between the plunger and the locking bolt is breached.

As the roller is in contact with the cam, a rotation by the cam causes a movement of the roller. When the locking bolt assumes the base position, the plunger is moved indirectly by the cam via the roller. It is hereby possible to configure the cam as component of the cam mechanism. The fuel pump normally interacts with the cam mechanism, with the plunger being moved as a result of a movement of the cam mechanism or is not moved, depending on whether the locking bolt is in the base position or in the rest position. A component of the cam mechanism, such as for example the roller, may also be a component of the fuel pump, depending on the definition being applied.

According to another advantageous feature of the present invention, provision can be made for a locking spring to bias the locking bolt in a direction of the base position, with the inner and outer sleeves being interconnected by the locking bolt. The locking spring can be acted upon by engine oil under pressure such that the locking spring is pushed into the inner sleeve and the locking bolt is moved to the rest position, when a force applied on the locking spring by the pressure of the engine oil exceeds a limit value to thereby cause a separation between the inner and outer sleeves.

According to another advantageous feature of the present invention, the conveying unit can be configured to deliver fuel only when the inner and outer sleeves are connected to one another, and to interrupt delivery of fuel when the inner and outer sleeves are detached from one another.

According to another advantageous feature of the present invention, the plunger can move in the cylinder at a delivery stroke, a level of which is variable by the cam mechanism. The cam mechanism is thus variably configured to change the delivery stroke of the plunger.

According to another aspect of the present invention, an injection system for a combustion engine includes a module including a fuel pump for conveying fuel, the fuel pump including a conveying unit having a cylinder, a plunger received in the cylinder, a spring received in the cylinder, an inner sleeve connected to the plunger, an outer sleeve in contact with the pump spring and in contact with a roller of a cam mechanism, and a locking bolt configured to detachably connect the inner and outer sleeves, and a fuel accumulator operably connected to the fuel pump of the module.

Fuel is pressurized by the fuel pump and delivered from the fuel pump to the fuel accumulator for storage under pressure.

According to another advantageous feature of the present invention, the conveying unit can be configured to deliver fuel only when the locking bolt assumes a base position, and to interrupt deliver of fuel when the locking bolt assumes a rest position.

According to another advantageous feature of the present invention, the fuel pump can include a number of conveying units which operate such that depending on an actual load point of the combustion engine, a first plurality of conveying unit is activated while a second plurality of conveying units is idle. In this way, a quantity of fuel under pressure and stored in the fuel accumulator can be controlled in dependence of the number of conveying units that are active or idle.

The fuel pump according to the present invention can thus have not only a single conveying unit with a plunger but several conveying units with several plungers, respectively. By integrating a locking bolt as a mechanical switching element for each plunger and the inner and outer sleeves, it becomes possible to switch off individual conveying units while still maintaining a continuous operation of the fuel pump so that fuel may be delivered under pressure by less than all conveying units. This renders operation of the fuel pump very efficient.

Integration of the cam mechanism which may be fully variable further enables a control of a pumping stroke of each plunger, so that a level of the stroke of the plunger can be controlled according to demand. Thus, the need for an otherwise typically provided metering unit can be eliminated and an amount of fuel to be delivered can be controlled solely through modifying the lift of the pumping stroke of the plunger.

Fuel consumption can be reduced in partial loads by decreasing a required drive power of the fuel pump as a result of less friction due to shutdown of at least one plunger. Thus, a number of pumping strokes of at least one plunger and a thus resultant friction is not dependent solely on a rotation speed of the combustion engine, and the fuel pump can be dimensioned not just as a function of a fuel demand. In the presence of a partial load that requires less fuel for the combustion engine, it is now possible to operate only some of all conveying units. It is hereby also possible to operate a plunger in full delivery mode or part delivery mode.

The fuel pump can be constructed as a so-called plug-in pump and can include several plungers. The fuel pump can be operated continuously, even though some of the plungers are idle. Several conveying units with plungers as components of a fuel pump are operatively connected to the fuel accumulator, which is also called common rail. During operation of the injection system, only those conveying units with plungers are activated as required for a corresponding load point and a reduced amount of fuel is set under pressure and stored in the fuel accumulator.

In a fuel pump according to the invention, a sleeve, typically referred to as roller cup, is provided to realize a connection between the roller, which is in contact with a cam, and the plunger and is of split configuration to define the inner sleeve and the outer sleeve. The inner sleeve is guided by and/or in the outer sleeve, with the outer sleeve contacting the roller and the pump spring. The inner sleeve is connected to the plunger of the fuel pump. The connection between the inner and outer sleeves is realized via the locking bolt which is biased by the locking spring. In the base position, the locking spring applies a force upon the locking bolt to seek the base position or locking position in which the inner and outer sleeves are rigidly connected to one another. Thus, it is possible for the plunger to interact with the roller via the interconnected inner and outer sleeves and hence also indirectly to interact with the cam, with fuel being guided and/or set under pressure via the plunger.

As an alternative, it is also possible to idle the plunger. For this purpose, the locking bolt is acted upon on the outside by engine oil which is under hydraulic pressure and applies a force in opposition to a force of the locking spring that biases the locking bolt to seek the base position. The pressure of the engine oil causes the locking bolt to be pushed into the inner sleeve, thereby separating the connection between the outer and inner sleeves. As a result, the outer sleeve follows via the roller a contour of the cam as the outer sleeve is acted upon by a force of the pump spring. The locking bolt assumes the rest position in which the plunger is decoupled from the roller and thus from the cam. The plunger is thus idle and no longer delivers any fuel. As the plunger is idle, no friction is caused for the fuel pump by this plunger.

BRIEF DESCRIPTION OF THE DRAWING

Other features and advantages of the present invention will be more readily apparent upon reading the following description of currently preferred exemplified embodiments of the invention with reference to the accompanying drawings.

DETAILED DESCRIPTION OF PREFERRED EMBODIMENTS

The depicted embodiment is to be understood as illustrative of the invention and not as limiting in any way. It should also be understood that the FIGURE may not necessarily be to scale. In certain instances, details which are not necessary for an understanding of the present invention or which render other details difficult to perceive may have been omitted.

Figure 1:
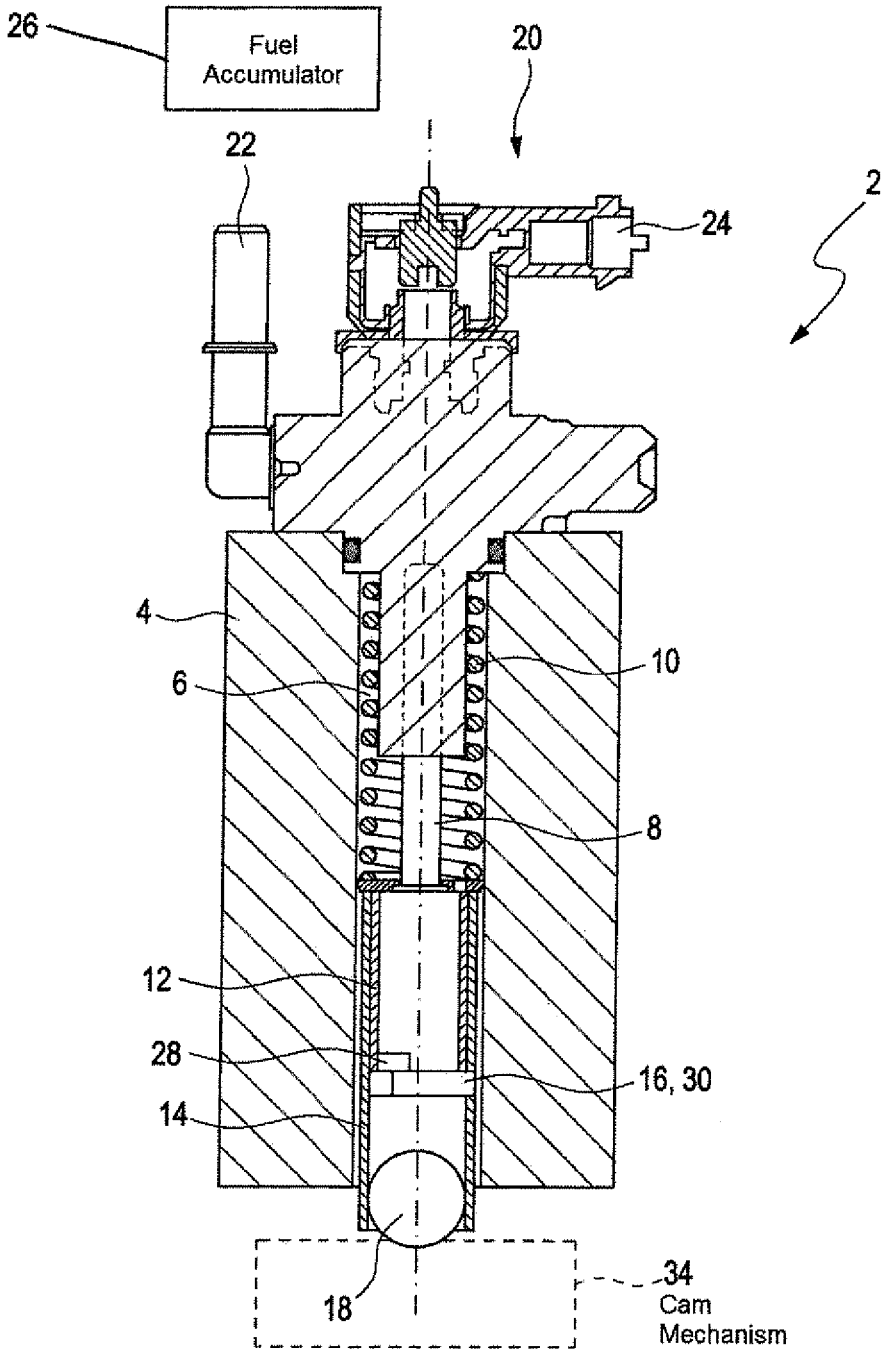
FIG. 1 is a schematic sectional view of a fuel pump according to the present invention showing a locking bolt in a base position.

Turning now to FIG. 1, there is shown a schematic sectional view of a fuel pump according to the present invention, generally designated by reference numeral 2. The fuel pump 2 includes a housing 4 which accommodates a cylinder 6 of a conveying unit. It will be appreciated by persons skilled in the art that the conveying unit contains further mechanical apparatus which has been omitted from FIG. 1 for the sake of simplicity. A plunger 8 or tappet of the fuel pump 2 is arranged for reciprocal movement within the cylinder 6 and is embraced by a pump spring 10 which is also arranged within the cylinder 6 and extends between a shoulder 11 of a connection module 20 and a top surface of an outer sleeve 14. The outer sleeve 14 is arranged in coaxial surrounding relation to an inner sleeve 12 and detachably connected to the inner sleeve 12 via a locking bolt 16. The plunger 8 is connected to the inner sleeve 12, whereas the outer sleeve 14 is connected at one end to the pump spring 10 and at the other end to a roller 18. The roller 18 represents a component of a cam mechanism 34, although it may also be considered as a component of the fuel pump 2, depending on the definition being applied.

The connection module 20 of the fuel pump 2 has a first inlet port 22 and a second inlet port 24, with one of the ports 22, 23 being configured for delivery of fuel to the conveying unit. The other one of the ports 22, 24 is configured to deliver fuel, which is pressurized by the plunger 8 in the cylinder 6 of the conveying unit, to a fuel accumulator from where fuel under pressure is delivered to downstream fuel injectors for injection of fuel into combustion chambers of a combustion engine. The fuel pump 2 and the fuel accumulator thus represent components of an injection system of the combustion engine.

As the fuel pump 2 pressurizes fuel, it is also referred to as high-pressure pump.

Figure 2:
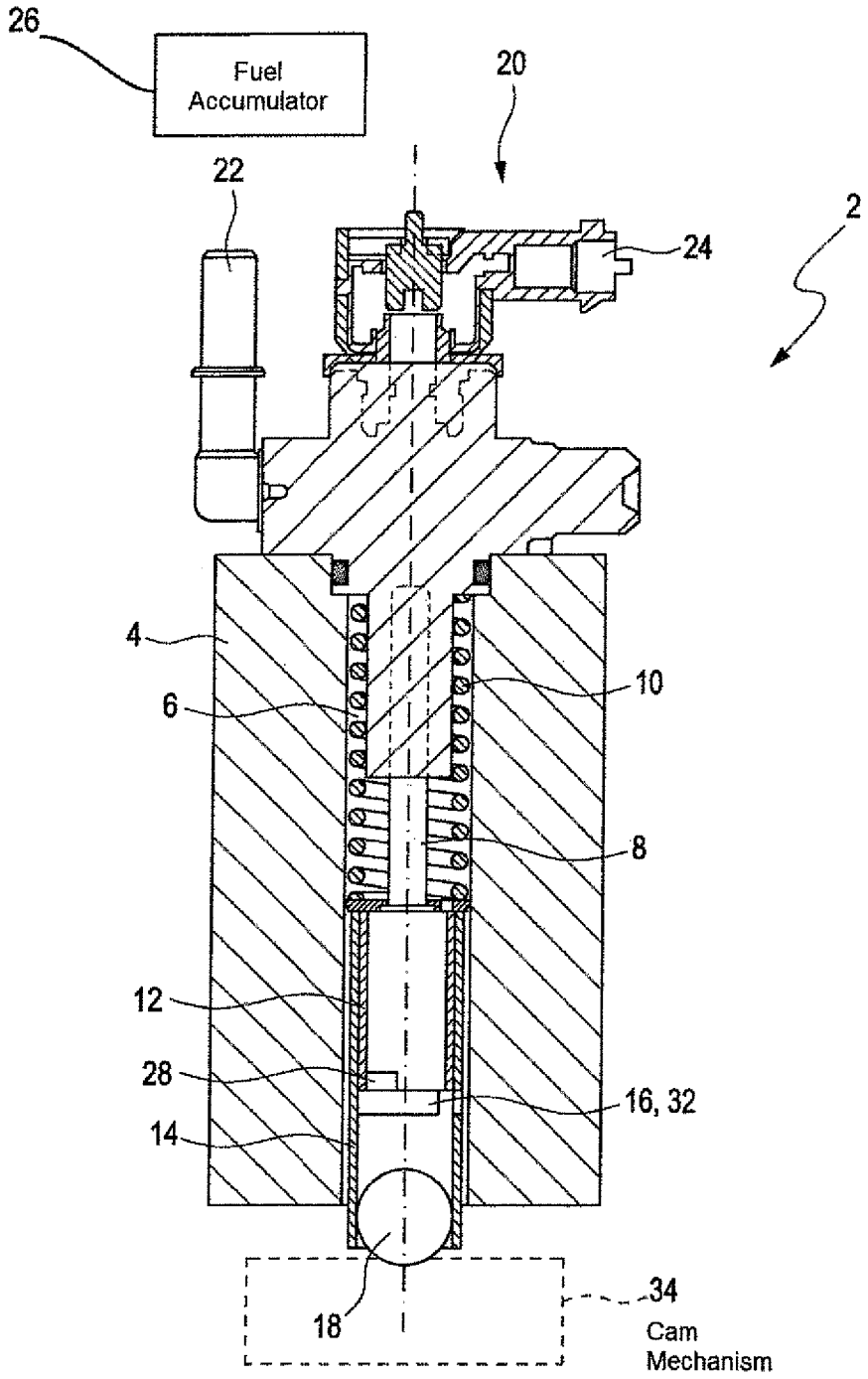
FIG. 2 is a schematic sectional view of a fuel pump according to the present invention showing a locking bolt in a rest position.

The inner sleeve 12 and the outer sleeve 14 of the fuel pump 2 are either coupled to one another or decoupled from one another via the locking bolt 16. The locking bolt 16 is biased by a locking spring 28 for movement in relation to the inner and outer sleeves 12, 14 between a base position 30, also referred to as locking position, as illustrated in FIG. 1 and a rest position 32, as illustrated in FIG. 2.

In the base position 30, the locking bolt 16 is biased by the locking spring 28 into engagement with the inner and outer sleeves 12, 14 so that the inner and outer sleeves 12, 14 are connected to one another. The inner and outer sleeves 12, 14 form hereby a mechanically interconnected unitary structure, with the plunger 8 and the roller 18 being mechanically connected to one another via the unitary structure of the inner and outer sleeves 12, 14. A cam of the cam mechanism 34 is in contact with the roller 18 so that a rotation of the cam is transferred via the roller 18 and the inner and outer sleeves 12, 14 onto the plunger 8 to thereby cause the plunger 8 to move within the cylinder 6. As a result, fuel is delivered via one of the ports 22, 24 to the conveying unit and pressurized by the moving plunger 8 for further delivery to the fuel accumulator.

The injection system thus includes the fuel pump 2 and one or more conveying units, each conveying unit having a plunger 8 that can be activated or can be idle. During operation of the combustion engine, it is therefore possible to reduce an amount of fuel that has been pressurized in the fuel accumulator for injection into a combustion chamber of the combustion engine.

Depending on the demand of fuel, at least one conveying unit of the fuel pump 2 can be switched off. For this purpose, provision is made for the locking bolt 16 to be moved from the base position 30, as shown in FIG. 1, into the rest position 32, as shown in FIG. 2, in opposition to the force applied by the locking spring 28 upon the locking bolt 16. The locking spring 28 is hereby acted upon by engine oil which applies a force, generated by the pressure of the engine oil and opposing the force applied by the locking spring 28 upon the locking bolt 16. When the force of the engine oil exceeds the force applied by the locking spring 28, the locking bolt 16 is pushed into the inner sleeve 12, thereby separating the mechanical connection between the inner and outer sleeves 12, 14. In other words, the mechanical connection between the inner and outer sleeves 12, 14 is no longer effective. As a result, a movement by the roller 18 is no longer transmitted to the plunger 8 so that the plunger 8 is idle, i.e. stationary at rest. The corresponding conveying unit is thus idle.

FIG. 1 shows the outer sleeve 14 by way of a cross sectional illustration through a cylindrical wall of the outer sleeve 14. An inner side of the wall of the outer sleeve 14 is partly covered by the inner sleeve 12, the locking bolt 16, and the roller 18, while only a portion of the inner side between the locking bolt 16 and the roller 18 is shown. FIG. 1 also shows the provision of a bore in the wall of the outer sleeve 14 for receiving one end of the locking bolt 16.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

What is claimed is:

1. A fuel pump for conveying fuel, comprising a conveying unit including a cylinder, a plunger received in the cylinder, a pump spring received in the cylinder, an inner sleeve connected to the plunger, an outer sleeve in contact with the pump spring and in contact with a roller of a cam mechanism, and a locking bolt configured to detachably connect the inner and outer sleeves, wherein the locking bolt is biased by a locking spring located above the locking bolt, wherein the plunger moves in the cylinder at a delivery stroke, a level of which is variable by the cam mechanism.

2. The fuel pump of claim 1, wherein the inner and outer sleeves are connected to one another in a base position of the locking bolt, and the inner and outer sleeve are detached from one another in a rest position of the locking bolt.

3. The fuel pump of claim 2, wherein the locking spring is configured to bias the locking bolt in a direction of the base position, said locking spring capable of being acted upon by engine oil under pressure such that the locking spring is pushed into the inner sleeve and the locking bolt is moved to the rest position, when a force applied on the locking spring by the pressure of the engine oil exceeds a limit value to thereby cause a detachment between the inner and outer sleeves.

4. The fuel pump of claim 1, wherein the conveying unit is configured to deliver fuel only when the inner and outer sleeves are connected to one another, and to interrupt delivery of fuel when the inner and outer sleeves are detached from one another.

5. An injection system for a combustion engine, comprising:

a module including a fuel pump for conveying fuel, said fuel pump including a conveying unit including a cylinder, a plunger received in the cylinder, a pump spring received in the cylinder, an inner sleeve connected to the plunger, an outer sleeve in contact with the pump spring and in contact with a roller of a cam mechanism, and a locking bolt configured to detachably connect the inner and outer sleeves, wherein the locking bolt is biased by a locking spring located above the locking bolt; and a fuel accumulator operably connected to the fuel pump of the module, wherein the plunger moves in the cylinder at a delivery stroke, a level of which is variable by the cam mechanism.

6. The injection system of claim 5, wherein the conveying unit is configured to deliver fuel only when the locking bolt assumes a base position, and to interrupt delivery of fuel when the locking bolt assumes a rest position.

7. The injection system of claim 5, wherein the inner and outer sleeves are connected to one another in a base position of the locking bolt, and the inner and outer sleeve are detached from one another in a rest position of the locking bolt.

8. The injection system of claim 7, wherein the locking spring is configured to bias the locking bolt in a direction of the base position, said locking spring capable of being acted upon by engine oil under pressure such that the locking spring is pushed into the inner sleeve and the locking bolt is moved to the rest position, when a force applied on the locking spring by the pressure of the engine oil exceeds a limit value to thereby cause a detachment between the inner and outer sleeves.

9. The injection system of claim 5, wherein the conveying unit is configured to deliver fuel only when the inner and outer sleeves are connected to one another, and to interrupt delivery of fuel when the inner and outer sleeves are detached from one another.

* * * * *